US011562873B2

(12) United States Patent
Shi et al.

(10) Patent No.: US 11,562,873 B2
(45) Date of Patent: Jan. 24, 2023

(54) MULTI-CATHODE MAGNETRON WITH INTERNAL ELECTROMAGNETIC FIELD COUPLING

(71) Applicant: Tsinghua University, Beijing (CN)

(72) Inventors: Jiaru Shi, Beijing (CN); Hao Zha, Beijing (CN); Jiayang Liu, Beijing (CN); Huaibi Chen, Beijing (CN); Chuanxiang Tang, Beijing (CN)

(73) Assignee: TSINGHUA UNIVERSITY, Beijing (CN)

( * ) Notice: Subject to any disclaimer, the term of this patent is extended or adjusted under 35 U.S.C. 154(b) by 6 days.

(21) Appl. No.: 17/371,311

(22) Filed: Jul. 9, 2021

(65) Prior Publication Data

US 2022/0020553 A1 Jan. 20, 2022

(30) Foreign Application Priority Data

Jul. 15, 2020 (CN) ..... 202010682116.3
Jul. 15, 2020 (CN) ..... 202021396792.6

(51) Int. Cl.
*H01J 25/587* (2006.01)
*H01J 23/05* (2006.01)
*H01J 23/213* (2006.01)

(52) U.S. Cl.
CPC ..... *H01J 25/587* (2013.01); *H01J 23/05* (2013.01); *H01J 23/213* (2013.01)

(58) Field of Classification Search
CPC ..... H01J 25/587; H01J 23/05; H01J 23/213
See application file for complete search history.

(56) References Cited

U.S. PATENT DOCUMENTS 4,833,367 A * 5/1989 Harada ..... H01J 23/54 315/39.53
2010/0163552 A1* 7/2010 Shim ..... H05B 6/6432 219/678

* cited by examiner

*Primary Examiner* — Joseph L Williams
(74) *Attorney, Agent, or Firm* — Hodgson Russ LLP

(57) ABSTRACT

A magnetron is provided and includes a tube body with a plurality of communicated first cavities therein, a plurality of anodes in the first cavities including a cylinder and a plurality of vanes, outer ends of the vanes are connected with an inner circumferential surface of the cylinder; a first resonant cavity and a second resonant cavity are formed between the adjacent vanes, the cylinder is provided with a plurality of coupling slots arranged at intervals and running through the cylinder to communicate the first resonant cavity with the first cavity; a plurality of cathode arranged in and coaxially with the cylinder; the cathodes and inner ends of the vanes are spaced apart; at least part of the cathodes are located inside vanes, and an output slot is defined on the tube body for communicating the first cavity with an outside.

20 Claims, 4 Drawing Sheets

MULTI-CATHODE MAGNETRON WITH INTERNAL ELECTROMAGNETIC FIELD COUPLING

CROSS-REFERENCE TO RELATED APPLICATIONS

The present disclosure is based upon and claims priority to Chinese Patent Application Nos. 202021396792.6 and 202010682116.3, filed on Jul. 15, 2020, the entire contents of which are incorporated by reference herein.

FIELD

The present disclosure relates to a field of microwave radiation sources technology, and more particularly to a magnetron.

BACKGROUND

Magnetron has advantages of simple structure, small volume, light weight, low cost and the like, and is widely applied to fields of national defense, industry, agriculture, medical treatment and the like as a high-power microwave source.

In order to realize high-efficiency microwave power combining, the related art adopts an injection phase locking technology to input a stable small signal into a magnetron, and frequency and phase of the magnetron output signal are locked by controlling frequency and phase of the small signal. However, the implementation of the above technology requires addition of a complex external injection phase locking system, which is costly and bulky, and weakens the advantages of the magnetron as the microwave source.

SUMMARY

The present disclosure seeks to solve at least one of the problems existing in a related art to at least some extent.

To this end, embodiments of the present disclosure provides a magnetron, which may achieve electromagnetic field coupling inside the magnetron, thereby improving output power of the magnetron without adopting a complex external injection phase locking system.

The magnetron according to embodiments of the present disclosure includes a tube body having a plurality of first cavities formed therein, the adjacent first cavities being communicated with each other; a plurality of anodes arranged in the first cavities and including a cylinder and a plurality of vanes arranged in the cylinder, the vanes extending along a radial direction of the cylinder, outer ends of the vanes being connected with an inner circumferential surface of the cylinder, the vanes being arranged along a circumferential direction of the cylinder at intervals, resonant cavities being formed between the adjacent vanes, the resonant cavities including a first resonant cavity and a second resonant cavity, the first resonant cavity alternately arranged along the circumferential direction of the cylinder, the cylinder being provided with a plurality of coupling slots arranged along the circumferential direction of the cylinder at intervals, and the coupling slots running through the cylinder along the radial direction of the cylinder to communicate the first resonant cavity with the first cavity; a plurality of cathodes arranged in the cylinder and coaxially arranged with the cylinder, the cathodes and inner ends of the vanes being spaced in the radial direction of the cylinder, and at least part of the cathodes being located inside the plurality of vanes; an output slot being defined on the tube body for communicating the first cavity with an outside.

The magnetron according to the embodiments of the present disclosure is provided with a plurality of cathodes and anodes, such that internal energy storage of the magnetron is increased, and output power of the magnetron is improved. The electromagnetic fields in the plurality of first cavities are coupled inside the magnetron, and the coupled electromagnetic fields lock output magnetron frequency without adopting a complex external injection phase-locking system, thereby reducing input cost of equipment and reducing volume of equipment.

DETAILED DESCRIPTION

Embodiments of the present disclosure are further described below in detail, examples of the embodiments are shown in accompanying drawings. The embodiments described below with reference to the accompanying drawings are exemplary, are merely used to explain the present disclosure, and cannot be construed as a limit to the present disclosure.

Figure 1:
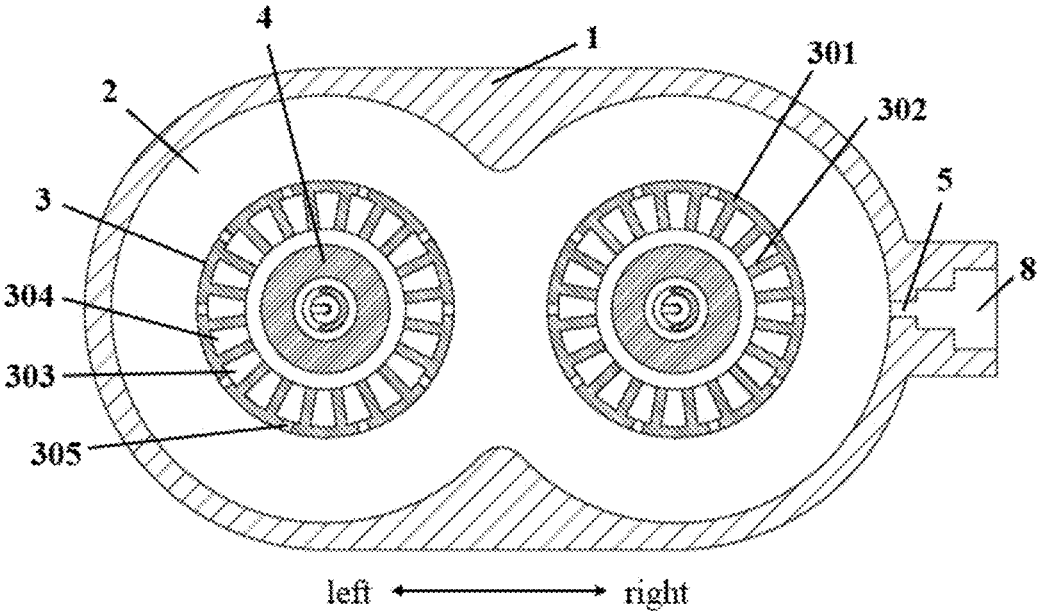
FIG. 1 is a schematic cross-sectional view illustrating a magnetron according to an embodiment of the present disclosure.
Figure 2:
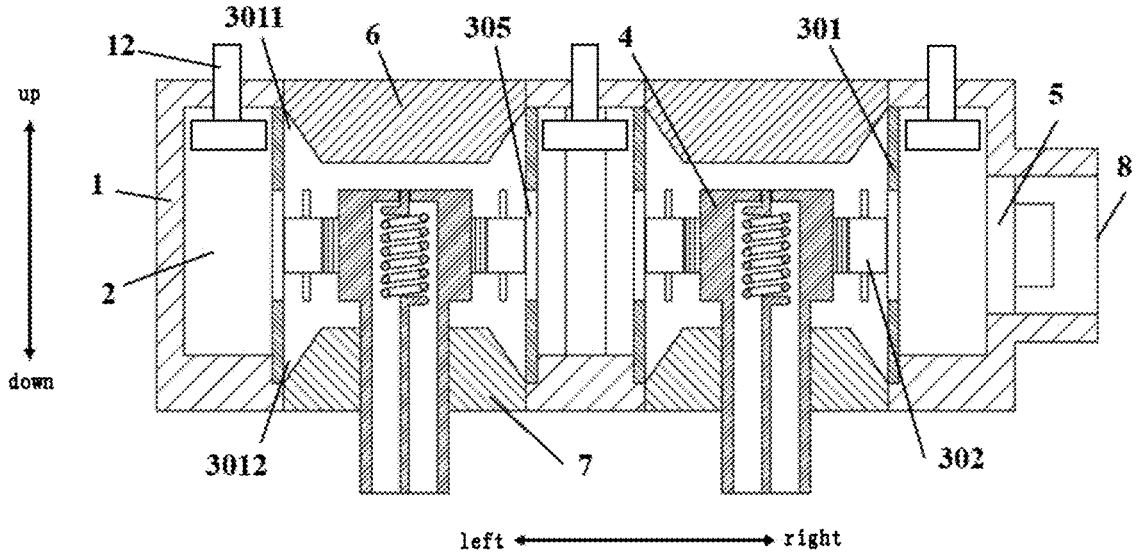
FIG. 2 is a schematic longitudinal sectional view illustrating the magnetron in FIG. 1.

As shown in FIGS. 1 and 2, a magnetron according to embodiments of the present disclosure includes a tube body 1, a plurality of anodes 3, and a plurality of cathodes 4.

A plurality of first cavities 2 are defined in the tube body 1, and the adjacent first cavities 2 are communicated with each other. As shown in FIGS. 1 to 6, an outer peripheral outline of a cross section of the first cavity 2 is in arc shape, which facilitates coupling of electromagnetic field inside the first cavity 2. The number of the first cavities 2 may be 2 to 4. It may be understood that the number of the first cavities 2 in the present application is not limited thereto.

The anode 3 is arranged in the first cavities 2 and includes a cylinder 301 and a plurality of vanes 302 arranged in the cylinder 301. The vanes 302 extend along a radial direction of the cylinder 301, outer ends of the vanes 302 are connected with an inner circumferential surface of the cylinder 301, the plurality of vanes 302 are arranged at intervals along a circumferential direction of the cylinder 301, and a resonant cavity is formed between the adjacent vanes 302. The plurality of resonant cavities include a first resonant cavity 303 and a second resonant cavity 304 alternately arranged along the circumferential direction of the cylinder 301. The cylinder 301 is provided with a plurality of coupling slots 305 arranged along the circumferential direction of the cylinder 301 at intervals, and the coupling slots 305 run through the cylinder 301 along the radial direction of the cylinder 301 to communicate the first resonant cavity 303 with the first cavity 2.

As shown in FIG. 2, the coupling slots 305 extend in an axial direction of the cylinder 301 (up-down direction shown in FIG. 2), there are a plurality of coupling slots 305 directly communicated with the plurality of first resonant cavities 303 in a one-to-one correspondence.

The cathode 4 is arranged in the cylinder 301 and is coaxial with the cylinder 301, the cathode 4 and inner ends of the vanes 302 are spaced apart in the radial direction of the cylinder 301, and at least part of the cathode 4 is located inside the plurality of vanes 302.

The tube body 1 is also defined with an output slot 5 for communicating the first cavity 2 with an outside. Electromagnetic field in the tube body 1 is output to the outside of the tube body 1 through the output slot 5. As shown in FIG. 2, the output slot 5 extends in an up-down direction. It may be understood that an extending direction of the output slot 5 in the present application is not limited thereto.

The magnetron according to embodiments of the present disclosure is provided with a plurality of cathodes and anodes, such that internal energy storage of the magnetron is increased, and output power of the magnetron is improved. The electromagnetic fields in the plurality of first cavities are coupled inside the magnetron, and the coupled electromagnetic fields lock output magnetron frequency without adopting a complex external injection phase-locking system, thereby reducing input cost of equipment and reducing volume of equipment.

In some embodiments, the cylinder 301 includes a first end and a second end in its axial direction (the up-down direction shown in FIG. 2), and the first end 3011 (upper end of the cylinder shown in FIG. 2) of the cylinder and the second end 3012 (lower end of the cylinder shown in FIG. 2) of the cylinder are open.

The magnetron further includes a first magnetic pole 6 and a second magnetic pole 7, magnetism of the first magnetic pole 6 is different from that of the second magnetic pole 7, and at least part of the first magnetic pole 6 is fitted in the cylinder 301 through the first end 3011 of the cylinder, and at least part of the second magnetic pole 7 is fitted in the cylinder 301 through the second end 3012 of the cylinder. The first magnetic pole 6 and the second magnetic pole 7 are arranged to form a static magnetic field in the cylinder 301 in the up-down direction. Electrons generate cycloidal motion under action of electric field and static magnetic field and gradually move to the resonant cavity.

As shown in FIG. 2, an upper end face of the first magnetic pole 6 is substantially flush with an outer surface of the tube body 1, and a lower end face of the second magnetic pole 7 is substantially flush with the outer surface of the tube body 1. Area of a lower end face of the first magnetic pole 6 is smaller than that of the upper end face of the first magnetic pole 6, and area of the lower end face of the second magnetic pole 7 is larger than that of an upper end face of the second magnetic pole 7.

In some embodiments, the tube body 1 is further defined with an output port 8 communicating the output slot 5 with the outside, and there are at least one output slot 5. The output slot 5 and the output port 8 are configured to output microwave signals.

Figure 3:
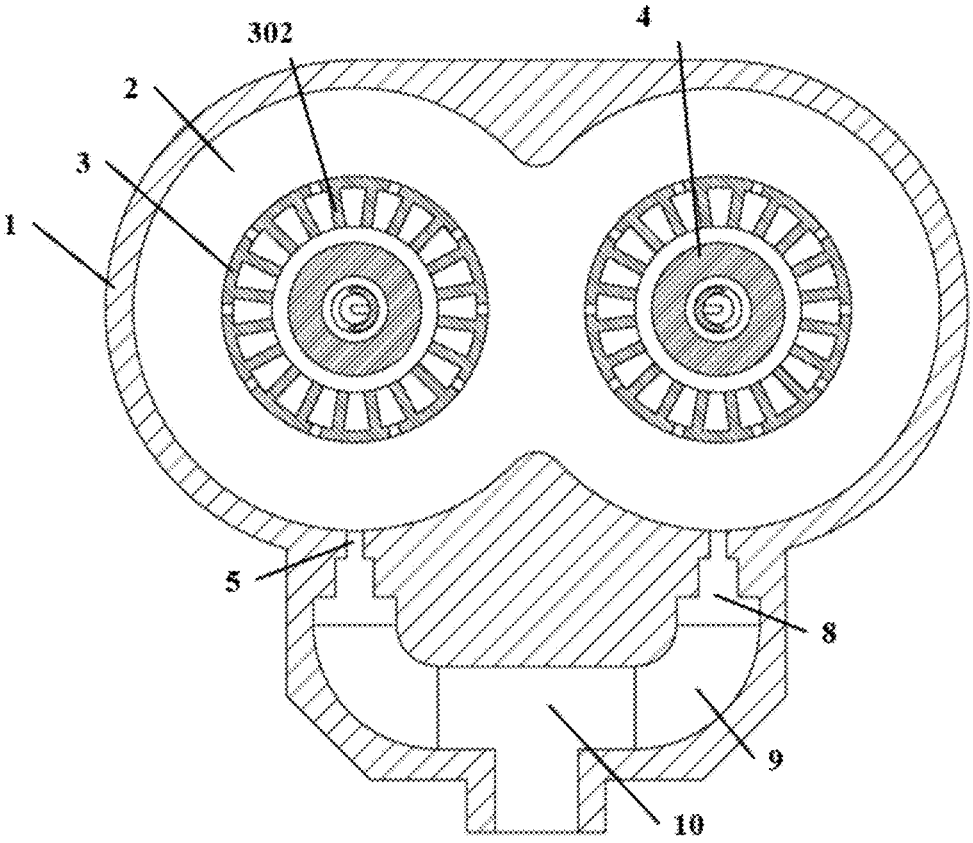
FIG. 3 is a schematic cross-sectional view illustrating a magnetron according another embodiment of the present disclosure.

As shown in FIGS. 1, 2 and 4-6, there is one output slot 5, or as shown in FIG. 3, there are two output slots. The number of output slots 5 in the present application is not limited thereto.

In some embodiments, there are a plurality of output slots 5, and the plurality of output slots 5 are directly communicated with the plurality of first cavities 2 in one-to-one correspondence. As shown in FIG. 3, there are two output slots 5, the left output slot 5 is communicated with the left first cavity 2, and the right output slot 5 is communicated with the right first cavity 2.

In some embodiments, the tube body 1 is further provided with a connecter 9 communicated with the output port 8, and the connecter 9 is communicated with the adjacent output slots 5. The magnetron further includes a combiner 10 arranged in the connecter 9. As shown in FIG. 3, the left output port 8 is communicated with a left inlet of the connecter 9, and the right output port 8 is communicated with a right inlet of the connecter 9, and the combiner 10 is arranged at the output port of the connecter 9. The microwave signals output from the plurality of output slots 5 are combined by the combiner 10, so as to obtain the required high-power microwave output.

In some embodiments, the combiner 10 includes an E-T structure. It may be understood that the structure of the combiner 10 in the present application is not limited thereto. For example, the structure of the combiner 10 may also be H-T or magic T.

Figure 4:
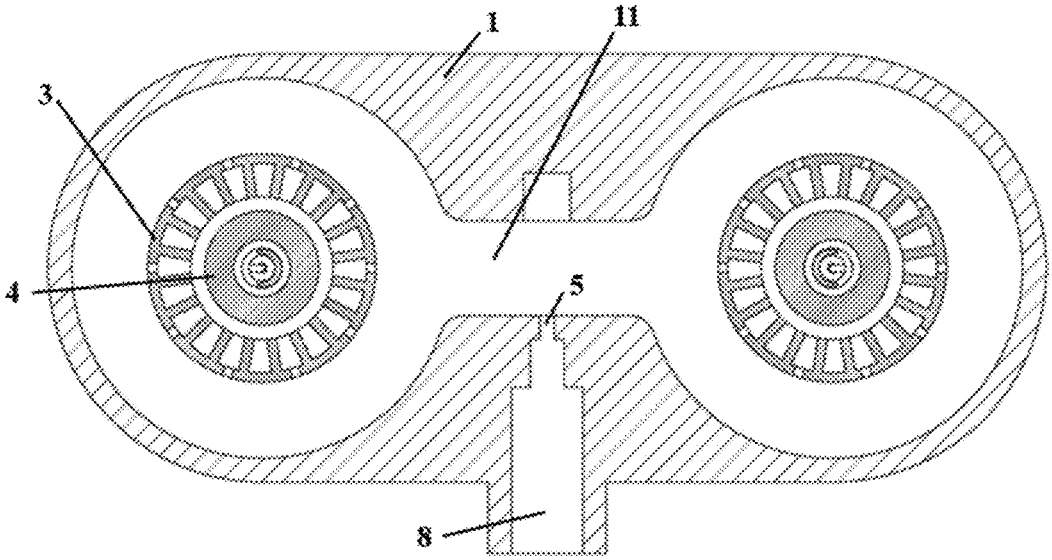
FIG. 4 is a schematic cross-sectional view illustrating a magnetron according to another embodiment of the present disclosure.

In some embodiments, the tube body 1 further includes a channel 11, the adjacent first cavities 2 are communicated through the channel 11, and the output slots 5 are directly communicated with the channel 11. As shown in FIG. 4, the channel 11 is connected between the left first cavity and the right first cavity.

In some embodiments, the magnetron further includes a tuner 12 configured for adjusting microwave frequency, the tuner 12 is arranged in the first cavity 2 and spaced apart from the anodes 3, and is movable along the axial direction of the cylinder 301 (up-down direction shown in FIG. 2). As shown in FIG. 2, an upper end of the tuner 12 extends out of the tube body 1 and is connected to an add-on adjusting system (not shown), the add-on adjusting system may drive the tuner 12 to move up and down. The microwave frequency may be adjusted by the arrangement of the tuner.

In some embodiments, there are a plurality of tuners 12 arranged at intervals and arranged between adjacent cylinders 301. As shown in FIG. 2, there are three tuners arranged at intervals in a left-right direction, and the tuner located in middle position is located between the two adjacent cylinders. It may be understood that the number of tuners in the present application is not limited thereto. Since the plurality of tuners 12 are provided, accuracy of microwave frequency adjustment may be improved by adjusting vertical positions of different tuners 12.

Figure 7:
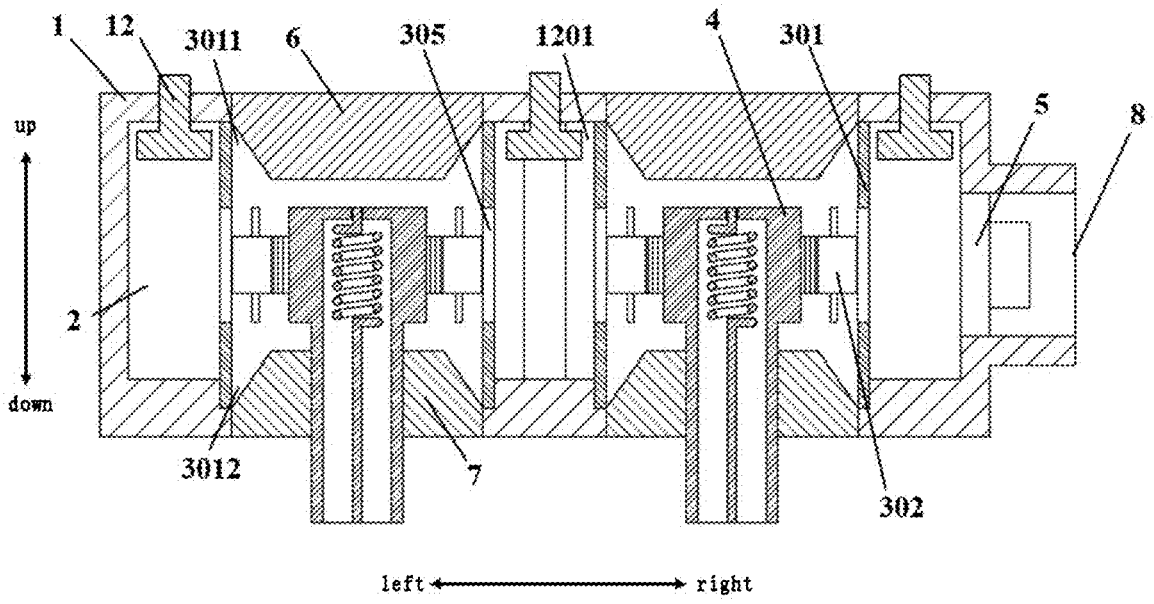
FIG. 7 is a schematic longitudinal sectional view illustrating a magnetron according to another embodiment of the present disclosure.

In some other embodiments, as shown in FIG. 7, there is one tuner 12 provided with a plurality of through holes 1201 in the up-down direction, a diameter of the through hole is slightly larger than a diameter of the cylinder 301, and the plurality of anodes are arranged in the through holes 1201 in one-to-one correspondence, and the anodes are coaxially arranged with the through holes 1201. The upper end of the tuner 12 extends out of the tube body 1 and is connected to an add-on adjusting system (not shown), and the add-on adjusting system may drive the tuner 12 to move up and down. The microwave frequency may be adjusted by the arrangement of the tuner.

The magnetrons according to some specific examples of the present disclosure will be described below with reference to FIGS. 1 and 2.

As shown in FIGS. 1 and 2, the magnetron according to embodiments of the present disclosure includes a tube body 1, a plurality of anodes 3 and a plurality of cathodes 4, and the tube body 1 has an output slot 5.

As shown in FIG. 1, there are two first cavities 2 in the tube body 1, and an outer peripheral outline of a cross section of the first cavity 2 is in circular-arc shape, and a circumference of the circular-arc shape is greater than a circumference of one-half circle.

The two first cavities 2 are arranged at intervals in the left-right direction and communicated with each other, and two anodes are correspondingly arranged in the two first cavities 2. The anodes include a cylinder 301 and a plurality of vanes 302 arranged in the cylinder 301. The vanes 302 extend along a radial direction of the cylinder 301, and outer ends of the vanes 302 are connected with an inner circumferential surface of the cylinder 301. The plurality of vanes 302 are arranged at intervals along the circumferential direction of the cylinder 301, and resonant cavities are formed between the adjacent vanes 302. The plurality of resonant cavities include first resonant cavities 303 and second resonant cavities 304 alternately arranged along the circumferential direction of the cylinder 301. The cylinder 301 is defined with a plurality of coupling slots 305 arranged at intervals along the circumferential direction of the cylinder 301, and the coupling slots 305 run through the cylinder 301 along the radial direction of the cylinder 301 to communicate the first resonant cavity 303 with the first cavity 2. Furthermore, the coupling slots 305 extend in the up-down direction, and there are a plurality of coupling slots 305 directly communicated with the first resonant cavities 303 in a one-to-one correspondence.

Two cathodes 4 are correspondingly arranged in the two cylinders 301, and the cathodes 4 are coaxially arranged with the cylinders 301. The cathodes 4 are spaced apart from inner ends of the vanes 302 in the radial direction of the cylinders 301, and at least part of the cathodes 4 are located inside the plurality of vanes 302.

As shown in FIGS. 1 and 2, there is one the output slot 5 extending along the up-down direction, and the output slot 5 communicates the right first cavity 2 with the outside. The tube body 1 is also defined with an output port 8 communicating the output slot 5 with the outside.

The cylinder 301 includes a first end and a second end in an axial direction, and the first end 3011 (upper end of the cylinder shown in FIG. 2) of the cylinder and the second end 3012 (lower end of the cylinder shown in FIG. 2) of the cylinder are opened. The magnetron further includes a first magnetic pole 6 and a second magnetic pole 7, magnetism of the first magnetic pole 6 is different from that of the second magnetic pole 7, and at least part of the first magnetic pole 6 is fitted in the cylinder 301 through the first end 3011 of the cylinder, and at least part of the second magnetic pole 7 is fitted in the cylinder 301 through the second end 3012 of the cylinder.

The magnetron further includes a tuner 12 configured for adjusting microwave frequency. The tuner 12 is arranged in the first cavity 2 and the anodes 3 are spaced apart, and is movable along the axial direction of the cylinder 301 (the up-down direction shown in FIG. 2). There are three tuners arranged at intervals in the left and right direction. The tuner in middle position is located between the two adjacent cylinders.

The magnetrons according to other specific exemplary of embodiments of the present disclosure will be described below with reference to FIG. 3.

As shown in FIG. 3, the magnetron according to embodiments of the present disclosure includes a tube body 1, a plurality of anodes 3 and a plurality of cathodes 4, and the tube body 1 has an output slot 5.

There are two output slots 5 extending along a radial direction of the first cavities 2, and there are two first cavities 2, two anodes and two cathodes. The two first cavities 2 are arranged at intervals in a left-right direction and communicated with each other. The left output slot 5 is communicated with the left first cavity 2, and the right output slot 5 is communicated with the right first cavity 2. The tube body 1 is also provided with a connecter 9 communicating with output ports 8, the left output port 8 is communicated with the left inlet of the connecter 9, and the right output port 8 is communicated with the right inlet of the connecter 9. The magnetron further includes a combiner 10 arranged in the connecter 9.

Other structures and operations of the magnetron shown in FIG. 3 may be the same as the embodiments shown in FIGS. 1 and 2, and will not be described in detail herein.

The magnetrons according to other specific exemplary of embodiments of the present disclosure will be described below with reference to FIG. 4.

As shown in FIG. 4, the magnetron according to embodiments of the present disclosure includes a tube body 1, a plurality of anodes 3 and a plurality of cathodes 4, and the tube body 1 has an output slot 5.

There are one output slot 5, two first cavities 2, two anodes and two cathodes. The two first cavities 2 are arranged at intervals in a left-right direction and are communicated through a channel 11, and the output slot 5 is directly communicated with a channel 11. Cross section of the channel 11 substantially is in rectangular shape, and the joint between the channel 11 and the first cavity 2 is an arc transition section connected with an arc shaped section.

Other structures and operations of the magnetron shown in FIG. 4 may be the same as the embodiments shown in FIGS. 1 and 2, and will not be described in detail here.

The magnetrons according to other specific exemplary of embodiments of the present disclosure will be described below with reference to FIG. 5.

Figure 5:
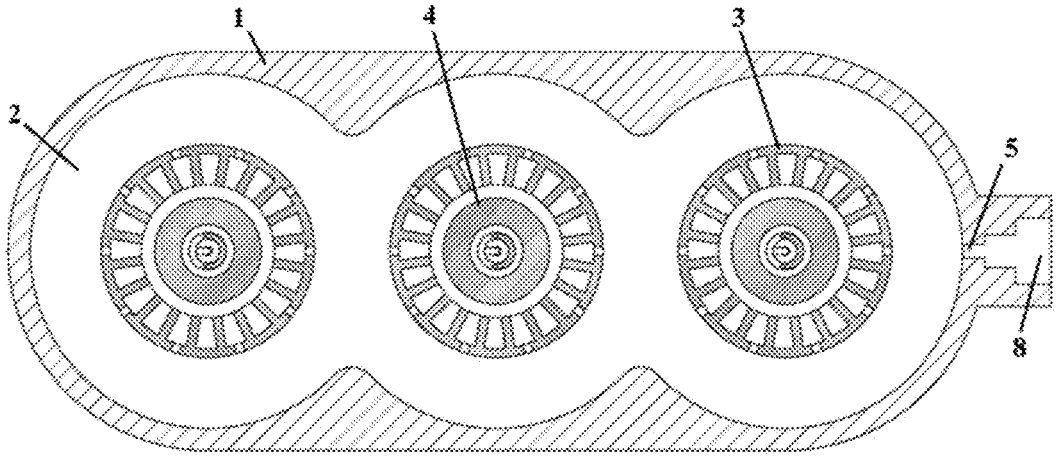
FIG. 5 is a schematic cross-sectional view illustrating a magnetron according to another embodiment of the present disclosure.

As shown in FIG. 5, the magnetron according to embodiments of the present disclosure includes a tube body 1, a plurality of anodes 3 and a plurality of cathodes 4, and the tube body 1 has an output slot 5. As shown in FIG. 5, there is one output slot 5, three first cavities 2, three anodes and three cathodes. The three first cavities 2 are arranged at intervals in a left-right direction and arranged in a straight line, and the output slot 5 is communicated with the rightmost first cavity 2. Outer peripheral outlines of cross sections of the left first cavity 2 and the right first cavity 2 are in circular-arc shapes, and circumference of the circular-arc shape is greater than the circumference of a half circle. Outer peripheral outline of the cross section of the middle first cavity 2 is also in circular-arc shape, and the circular-arc shape of the middle first cavity 2 includes a first arc section and a second arc section arranged at intervals along a circumferential direction, and the circumferences of the first arc section and the second arc section are both smaller than the circumference of a half circle.

Other structures and operations of the magnetron shown in FIG. 5 may be the same as the embodiments shown in FIGS. 1 and 2, and will not be described in detail here.

The magnetrons according to other specific exemplary of embodiments of the present disclosure will be described below with reference to FIG. 6.

Figure 6:
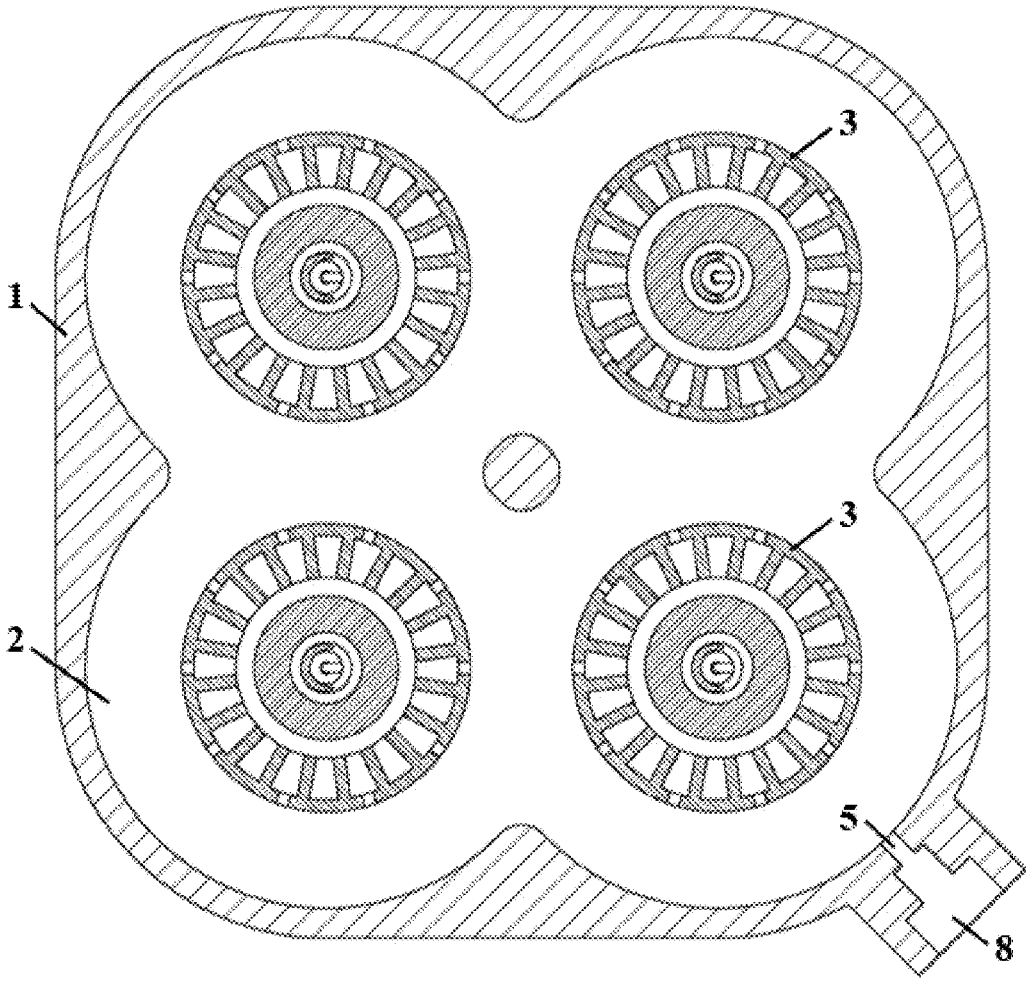
FIG. 6 is a schematic cross-sectional view illustrating a magnetron according to another embodiment of the present disclosure.

As shown in FIG. 6, the magnetron according to embodiments of the present disclosure includes a tube body 1, a plurality of anodes 3 and a plurality of cathodes 4, and the tube body 1 has an output slot 5.

As shown in FIG. 6, there is one output slot 5, four first cavities 2, four anodes and four cathodes, and the four first cavities 2 are arranged in a two-by-two grid shape in the tube body. Outer peripheral outline of cross section of the first cavity 2 is in circular-arc shape, and the circumference of the circular-arc shape substantially is equal to a circumference of a half circle.

Other structures and operations of the magnetron shown in FIG. 6 may be the same as the embodiments shown in FIGS. 1 and 2, and will not be described in detail here.

In the specification, it is to be understood that terms such as "central," "longitudinal," "lateral," "length," "width," "thickness," "upper," "lower," "front," "rear," "left," "right," "vertical," "horizontal," "top," "bottom," "inner," "outer," "clockwise," "counterclockwise," "axial," "radial," and "circumferential" should be construed to refer to the orientation as then described or as shown in the drawings under discussion. These relative terms are for convenience of description and do not require that the present invention be constructed or operated in a particular orientation.

In addition, terms such as "first" and "second" are used herein for purposes of description and are not intended to indicate or imply relative importance or significance. Furthermore, the feature defined with "first" and "second" may include one or more this feature distinctly or implicitly. In the description of the present disclosure, "a plurality of" means two or more than two, unless specified otherwise.

In the present invention, unless specified or limited otherwise, the terms "mounted," "connected," "coupled," "fixed" and the like are used broadly, and may be, for example, fixed connections, detachable connections, or integral connections; may also be mechanical or electrical connections; may also be direct connections or indirect connections via intervening structures; may also be inner communications of two elements, which may be understood by those skilled in the art according to specific situations.

In the present invention, unless specified or limited otherwise, a structure in which a first feature is "on" or "below" a second feature may include an embodiment in which the first feature is in direct contact with the second feature, and may further include an embodiment in which the first feature and the second feature are not in direct contact with each other, but are contacted via an additional feature formed therebetween. Furthermore, a first feature "on," "above," or "on top of" a second feature may include an embodiment in which the first feature is right or obliquely "on," "above," or "on top of" the second feature, or just means that the first feature is at a height higher than that of the second feature; while a first feature "below," "under," or "on bottom of" a second feature may include an embodiment in which the first feature is right or obliquely "below," "under," or "on bottom of" the second feature, or just means that the first feature is at a height lower than that of the second feature.

Reference throughout this specification to "an embodiment," "some embodiments," "an example," "a specific example," or "some examples," means that a particular feature, structure, material, or characteristic described in connection with the embodiment or example is included in at least one embodiment or example of the present disclosure. The appearances of the above phrases in various places throughout this specification are not necessarily referring to the same embodiment or example of the present disclosure. Furthermore, the particular features, structures, materials, or characteristics may be combined in any suitable manner in one or more embodiments or examples. In addition, different embodiments or examples and features of different embodiments or examples described in the specification may be combined by those skilled in the art without mutual contradiction.

Although embodiments of present disclosure have been shown and described above, it should be understood that above embodiments are just explanatory, and cannot be construed to limit the present disclosure, for those skilled in the art, changes, alternatives, and modifications may be made to the embodiments without departing from the scope of the present disclosure.

What is claimed is:

1. A magnetron, comprising:

a tube body having a plurality of first cavities formed therein, with adjacent first cavities being communicated with each other;

a plurality of anodes arranged in the first cavity and comprising a cylinder and a plurality of vanes arranged in the cylinder, the vanes extending along a radial direction of the cylinder, outer ends of the vanes being connected with an inner circumferential surface of the cylinder, the vanes being arranged along a circumferential direction of the cylinder at intervals, resonant cavities being formed between the adjacent vanes, the resonant cavities comprising a first resonant cavity and a second resonant cavity, the first resonant cavity alternately arranged along the circumferential direction of the cylinder, the cylinder being provided with a plurality of coupling slots arranged along the circumferential direction of the cylinder at intervals, and the coupling slots running through the cylinder along the radial direction of the cylinder to communicate the first resonant with the first cavity;

a plurality of cathodes arranged in the cylinder and coaxially arranged with the cylinder, the cathodes and inner ends of the vanes being spaced in the radial direction of the cylinder, and at least part of the cathodes being located inside the plurality of vanes; and an output slot being defined on the tube body for communicating the first cavity with an outside.

2. The magnetron according to claim 1, wherein the cylinder comprises a first end and a second end in an axial direction of the cylinder, the first end and the second end of the cylinder are open, and the magnetron further comprises a first magnetic pole and a second magnetic pole, magnetism of the first magnetic pole is different from magnetism of the second magnetic pole, at least part of the first magnetic pole is fitted in the cylinder through the first end of the cylinder, at least part of the second magnetic pole is fitted in the cylinder through the second end of the cylinder.

3. The magnetron according to claim 1, wherein the tube body is further defined with an output port communicating the output slot with an outside, and there are at least one output slot.

4. The magnetron according to claim 3, wherein there are a plurality of output slots directly communicated with the plurality of first cavities in one-to-one correspondence.

5. The magnetron according to claim 4, wherein the tube body is further provided with a connecter communicated with the output port, the connecter is communicated with the adjacent output slots, and the magnetron further comprises a combiner arranged in the connecter.

6. The magnetron according to claim 5, wherein the combiner comprises but is not limited to an E-T structure.

7. The magnetron according to claim 4, wherein the tube body further comprises a channel the adjacent first cavities are communicated through the channel, and the output slots are directly communicated with the channel.

8. The magnetron according to claim 1, further comprising a tuner configured for adjusting microwave frequency, the tuner being arranged in the first cavity and the anodes being spaced apart, the tuner being movable in an axial direction of the cylinder.

9. The magnetron according to claim 8, wherein there are a plurality of tuners arranged at intervals, and the tuner is arranged between the adjacent cylinders.

10. The magnetron according to claim 1, wherein an outer peripheral outline of a cross section of the first cavity is in arc shape.

11. The magnetron according to claim 2, wherein an upper end face of the first magnetic pole is flush with an outer surface of the tube body, and a lower end face of the second magnetic pole is flush with the outer surface of the tube body.

12. The magnetron according to claim 11, wherein area of a lower end face of the first magnetic pole is smaller than area of the upper end face of the first magnetic pole, and area of the lower end face of the second magnetic pole is larger than area of an upper end face of the second magnetic pole.

13. The magnetron according to claim 2, wherein the tube body is further defined with an output port communicating the output slot with an outside, and there are at least one output slot.

14. The magnetron according to claim 5, wherein the combiner comprises but is not limited to a H-T structure.

15. The magnetron according to claim 5, wherein the combiner comprises but is not limited to a magic T structure.

16. The magnetron according to claim 5, wherein the tube body further comprises a channel, the adjacent first cavities are communicated through the channel, and the output slots are directly communicated with the channel.

17. The magnetron according to claim 2, further comprising a tuner configured for adjusting microwave frequency, the tuner being arranged in the first cavity and the anodes being spaced apart, the tuner being movable in an axial direction of the cylinder.

18. The magnetron according to claim 3, further comprising a tuner configured for adjusting microwave frequency, the tuner being arranged in the first cavity and the anodes being spaced apart, the tuner being movable in an axial direction of the cylinder.

19. The magnetron according to claim 4, further comprising a tuner configured for adjusting microwave frequency, the tuner being arranged in the first cavity and the anodes being spaced apart, the tuner being movable in an axial direction of the cylinder.

20. The magnetron according to claim 5, further comprising a tuner configured for adjusting microwave frequency, the tuner being arranged in the first cavity and the anodes being spaced apart, the tuner being movable in an axial direction of the cylinder.

* * * * *